United States Patent [19]

Spaller, Jr.

[11] 3,953,314

[45] Apr. 27, 1976

[54] ELECTROLYTIC CELL CONSTRUCTION

[75] Inventor: Albert Edward Spaller, Jr., Johnson City, Tenn.

[73] Assignee: Eastman Kodak Company, Rochester, N.Y.

[22] Filed: Dec. 23, 1974

[21] Appl. No.: 536,045

[52] U.S. Cl. ..... 204/272; 204/275

[51] Int. Cl.[2] ..... C25C 7/00; C25C 7/02

[58] Field of Search ..... 204/78, 260, 272, 275

[56] References Cited

UNITED STATES PATENTS 3,076,754 2/1963 Evans ..... 204/272 X 3,509,031 4/1970 Covitz ..... 204/78

FOREIGN PATENTS OR APPLICATIONS 1,104,078 2/1968 United Kingdom ..... 204/272

*Primary Examiner*—Howard S. Williams
*Assistant Examiner*—A. C. Prescott
*Attorney, Agent, or Firm*—J. Frederick Thomsen; Daniel B. Reece, III

[57] ABSTRACT

An electrolytic cell useful in the oxidation of organic compounds is disclosed. The cell eliminates or substantially reduces undesirable tar formation in certain areas of the anode.

5 Claims, 1 Drawing Figure

ELECTROLYTIC CELL CONSTRUCTION

Figure 1:
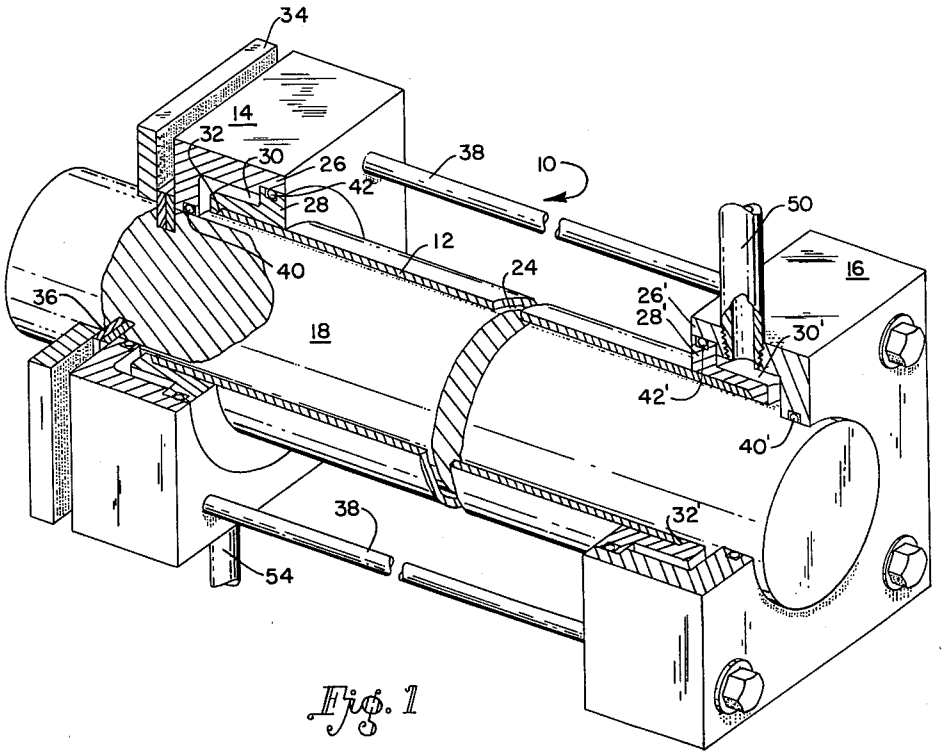

This invention relates generally to electrochemical oxidation processes and more specifically this invention relates to improved electrolytic cell construction for the oxidation of organic compounds.

The electrolytic oxidation of organic compounds is well known in the art. For example, U.S. Pat. No. 3,509,031 teaches the preparation of hydroquinone by electrolyzing an aqueous solution of phenol. Other well known electrolytic oxidation processes include oxidation of benzene to p-benzoquinone, such as disclosed in Belgium Pat. No. 777,905. Numerous other electrolytic oxidation processes are known in the art.

Electrolytic cells are conveniently cylindrical in shape, i.e., having a hollow cylindrical cathode, and a cylindrical anode smaller in size than the cathode adapted to be positioned inside the cathode in coaxial alignment therewith so as to define an annular passage extending for the length of the cell for flow of the compound to be oxidized. In the past, it has been conventional practice in such electrolytic cells to simply provide single inlet and discharge ports in the periphery of the cathode, thereby providing unsymmetrical and uneven flow through the annular passage between the anode and cathode. The electrolytic cell constructed in accordance with this invention provides an improved seal and flow distribution between the anode and cathode.

The higher electrical efficiency realized using this process results in a lower cost per pound of product produced in the process, thereby allowing one to economically achieve higher concentrations of oxidized compound in the product stream, thus reducing the capital requirements for a plant.

This invention is especially important with respect to the electrochemical oxidation of phenol to hydroquinone, including the electrochemical oxidation of substituted phenols such as o-cresol to corresponding substituted hydroquinone.

The term "phenol," as used herein, is intended to include alkyl-substituted phenols wherein the alkyl groups have a carbon content of 1 to 4 carbon atoms and are positioned ortho or meta to the hydroxyl group, and the term "hydroquinone," as used herein, is intended to include alkyl-substituted hydroquinones wherein the alkyl group has a carbon content of 1 to 4 carbon atoms.

It is therefore an object of this invention to provide an improved electrolytic cell construction.

It is another object of this invention to provide an improved electrolytic cell for the electrolytic oxidation of organic compounds wherein flow characteristics and seals of the electrolytic cell are substantially improved.

It is a further object of this invention to provide an improved electrolytic cell for the electrochemical oxidation of phenol to hydroquinone wherein good yields of hydroquinone are obtained.

It is still another object of this invention to provide means for easily and precisely aligning the anode and cathode.

According to the present invention, an electrolytic cell is provided which is especially suitable for the oxidation of aromatic compounds, particularly oxidation of phenol to hydroquinone. For example, U.S. Pat. No. 3,509,031 discloses a process for oxidizing phenol to hydroquinone or benzoquinone at high chemical and electrical efficiencies by electrolyzing aqueous solutions of phenol at temperatures of 25° to about 100°C., a pH of less than about 4 at a current density of 4 to about 100 amperes/dm$^2$ until up to about 80% by weight of the phenol has been electrolyzed. This patent points out that an undivided cell provides hydroquinone as the main product of the electrolysis of phenol.

The present invention provides an electrolytic cell which is especially useful in producing hydroquinone in accordance with the process described in this patent, i.e., in an undivided cell.

In the drawing:

FIG. 1 is a perspective view, partly in section of an electrolytic cell constructed in accordance with this invention.

Referring now to the drawing, electrolytic cell 10 includes a hollow, cylindrical cathode 12 having insulating end members 14 and 16 which serve the purposes of providing end seals, insulating the electrodes from each other and distributing flow. A cylindrical anode 18 is positioned within the cathode 12 and extends for substantially the full length thereof. The cathode 12 and anode 18 define an annular passage 24 for flow of the compound to be oxidized.

End members 14 and 16 may conveniently be identical in construction. For the sake of simplicity, therefore, only member 14 will be described in detail. Corresponding parts of member 16 are indicated by primed numbers (′). End member 14 comprises a pair of circular elements 26 and 28 made of an insulating material such as plastic. Elements 26 and 28 are generally L-shaped in cross section and define a circular opening 30 extending around the circumference of the cell 10. Element 28 is fixed to the periphery of cathode 12 and forms a liquid tight seal at 32. Element 26 is maintained in place by retainer plate 34, retainer ring 36 and a plurality of tie bolts 38 connecting the end members 14 and 16. O-ring 40 forms a liquid tight seal between element 26 and anode 18. O-ring 42 provides a liquid tight seal between elements 26 and 28. Liquid compound to be oxidized flows into inlet 50 from a feed line (not shown) around the circular opening or manifold 30′ of end member 16, down the annular passage 24 between anode 18 and cathode 12 to the circular opening 30 of end member 14 and out through the discharge port 54 fixed to element 26 of end member 14. In this manner, flow is evenly distributed around the annular passage 24 for the entire length thereof, so as not to form dead spots of restricted flow near the ends of the passage 24.

The cathode 12 and anode 18 may be fabricated from conventional materials known to those skilled in the art. As to the choice of anode materials, any metal which is stable in the electrolyte may be used, such as, for example, platinum, gold, graphite, manganese, chromium, iron, nickel, lead and alloys thereof and the like. Lead dioxide is preferred as the anode material for oxidation of phenol to p-benzoquinone. As the cathode material, any metal which is stable to the electrolysis conditions described in the present invention may be employed as the cathode in the present invention. Suitable cathode materials include such metals as steel, lead, tin, cadmium, copper, nickel, and the like. Of course, it is to be understood that the list of these materials mentioned as being useful as anodes and cathode is not exclusive and any of the metals which meet the above qualifications may be used if desired.

The insulating end members 14 and 16 may be fabricated from suitable materials such as, for example, plastic. Polypropylene is found to be suitable for this purpose.

Operation of the electrolytic cell will now be described with reference to the oxidation of phenol to hydroquinone. The electrolytic cell constructed in accordance with this invention is used according to known techniques. For example, one suitable process is disclosed in the aforementioned U.S. Pat. No. 3,509,031.

When this invention is practiced in the preferred continuous process, temperatures of about 25° to 100°C. can be used. It is preferred to operate continuously in the range of about 30° to 80°C., with the range of about 40°–70°C. being more preferred.

The concentration of phenol in aqueous solution being electrolyzed is limited to an upper limit of about 4 percent by weight, and a lower practical limit of about 0.5 percent by weight. Although the concentration of phenol in the aqueous solution can be as high as about 4 percent by weight, about 1 to about 3 percent is preferred. Above 4 percent phenol concentration, conversion efficiency drops, the remainder appearing as tars or low molecular weight condensation products which adhere to the electrode surface. Conventional cosolvents may be used. Tar formation as mentioned before is responsible to some extent in reducing electrical efficiency as the electrolysis proceeds. It is preferred not to exceed a hydroquinone-quinone concentration of about 3% by weight.

The concentration of electrolyte is not narrowly critical, but it is preferred to operate in the range of about 1 to 5 percent by weight when the electrolyte is an inorganic acid. This range is preferred because of the relatively minor variations in electrical efficiency over this range as well as having sufficient conductivity to allow high current densities without excessive heating from power dissipation. When the electrolyte consists of a mixture of an inorganic acid and an ionizable salt, the salt concentration can range from about 1 to 10 percent by weight, or 1 to 20 percent by weight and even as high as about 30 percent by weight.

Suitable electrolytes comprise any materials which ionize readily in water at a pH of 4 or less and preferably 2 or less and do not interfere with the phenol electrolysis. Specific examples include inorganic acids, such as sulfuric acid, phosphoric acid and the like; inorganic salts such as sodium sulfate, sodium bisulfate, potassium sulfate, potassium bisulfate, lithium sulfate, lithium bisulfate, sodium phosphate and the like, in conjunction with sufficient inorganic acid to maintain a pH of 4 or less; and organic salts such as sodium acetate, potassium acetate, lithium acetate, and the like, in a solution acidified to a pH of 4 or less.

In order to maintain optimum anode efficiency, one may clean the electrodes by immersion in a hydrocarbon tar solvent, as for example, ketones such as acetone, alcohols such as ethanol, or aromatic hydrocarbons such as benzene, toluene, and the like. This can be done by a rinsing operation in which the electrodes are left intact mounted in the electrolytic cell. In the most preferred ranges of current density, later defined, this cleaning operation is not required.

An important variable of the present process is the anode potential. This value has a minimum below which oxidation of phenol by electrolysis will not occur. This value is approximately +0.9 volt with respect to a saturated calomel electrode as measured by standard voltammetric techniques. It is preferred to employ an anode potential of about +0.9 to +3.5 volts with a range of +1.8 to +3.0 volts being more preferred. The cathode potential should be less than about +0.4 volt.

The current density is also important since, for a given system, the electrode potential is usually a single-valued function of the current density. The electrode potential may therefore be controlled by adjusting the current density. Also, since the conversion rate per unit area of electrode surface is determined as much by the current density as by the electrical efficiency, it is desirable to operate at high current densities. The preferred range of current densities for the oxidation of phenol by electrolysis is about 4 to 100 amperes/dm.$^2$ with about 20 to about 60 being especially preferred. It is not practical to operate below 4 amperes/dm.$^2$ because of tar formation on the anode which lowers the efficiency of the phenol electrolysis to a point where the oxidative process is no longer commercially feasible. The use of high current densities in the practice of this process carries with it the added economic advantage of reducing the number of cells required for the electrolytic oxidation of phenol.

Pressure is not critical and, while it is preferred to use atmospheric pressure for convenience, superatmospheric as well as subatmospheric pressures may be employed if desired.

The degree of conversion to which the phenol substrate is subjected is important. For example, after about 50 percent conversion of phenol to hydroquinone by electrolysis, the overall electrical efficiency begins to drop. Approximately 80 percent was therefore determined as the upper practical limit of conversion of phenol. The formation of side products becomes more appreciable above the 80 percent phenol conversion level and aside from the depreciation in yield, conversion beyond this point is undesirable because of tar sticking to the electrode surface which results in reduction in the rate of diffusion of phenol to the anode.

The product stream can be continuously extracted with a low boiling, water-immiscible solvent, such as diethyl ether, in which the organic materials are soluble. The ether stream can be then fed into a vessel containing a higher boiling solvent in which both phenol and p-benzoquinone are soluble but in which hydroquinone is quite insoluble, such as, carbon tetrachloride. The ether is recycled and the hydroquinone filtered from the carbon tetrachloride solution and subsequently recrystallized in conventional apparatus. The carbon tetrachloride filtrate which contains traces of p-benzoquinone, as well as unreacted phenol, can be re-extracted with the aqueous phase from the first extraction and reused. The aqueous phase can then be returned to the electrolysis cell after appropriate replenishment with phenol.

Although the invention has been described in considerable detail with particular reference to certain preferred embodiments thereof, variations and modifications can be effected within the spirit and scope of the invention.

I claim:

1. An electrolytic cell adapted for the oxidation of an aromatic compound during passage through said cell comprising a hollow, cylindrical cathode and a cylindrical anode smaller in diameter than the inside diameter of said cathode positioned therein so as to form an annular passage between said anode and cathode, said anode being at least co-extensive with said cathode, insulating end manifolds circumferentially engaging each end of said cathode and extending beyond said ends, said end manifolds having annular cavities circumferentially communicating with said annular passage, said anode being maintained in axial alignment with said cathode by the end manifolds, means forming liquid tight seals between said anode and said end members, and one of said end members having a feed inlet and the other having a discharge outlet communicating with said cavities.

2. An electrolytic cell according to claim 1 wherein an O-ring forms the seal between said anode and said end manifolds.

3. An electrolytic cell according to claim 1 wherein each of said end manifolds comprises an inner circular part and an outer circular part, said inner and outer circular parts forming an annular cavity which communicates with said annular passage, one of said parts forming a seal with said cathode and one of said parts forming a seal with said anode.

4. An electrolytic cell according to claim 1 wherein said end manifolds are fabricated from a plastic material.

5. An electrolytic cell according to claim 1 wherein said end manifolds are fabricated from polypropylene.

* * * * *